US008465147B2

(12) United States Patent
Tanahashi

(10) Patent No.: US 8,465,147 B2
(45) Date of Patent: Jun. 18, 2013

(54) INK-JET RECORDING APPARATUS

(75) Inventor: Naokazu Tanahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 276 days.

(21) Appl. No.: 13/072,001

(22) Filed: Mar. 25, 2011

(65) Prior Publication Data

US 2012/0081445 A1 Apr. 5, 2012

(30) Foreign Application Priority Data

Sep. 30, 2010 (JP) ..... 2010-222910

(51) Int. Cl.
*B41J 2/01* (2006.01)

(52) U.S. Cl.
USPC ..... 347/104; 347/16; 400/56; 271/3.14

(58) Field of Classification Search
CPC ..... B41J 11/005
USPC ..... 347/16, 101, 104; 400/56, 58; 271/3.14, 271/272, 264
See application file for complete search history.

(56) References Cited

U.S. PATENT DOCUMENTS

| | | | | |
|---|---|---|---|---|
| 5,940,092 | A | 8/1999 | Kashimura et al. | |
| 7,681,969 | B2 * | 3/2010 | Hamakawa et al. | 347/8 |
| 2006/0023050 | A1 * | 2/2006 | Nishiberi et al. | 347/104 |

FOREIGN PATENT DOCUMENTS

| | | |
|---|---|---|
| JP | 9-234916 | 9/1997 |
| JP | 2006-15533 | 1/2006 |

* cited by examiner

*Primary Examiner* — Julian Huffman
*Assistant Examiner* — Sharon A Polk
(74) *Attorney, Agent, or Firm* — Scully, Scott, Murphy & Presser, P.C.

(57) ABSTRACT

An ink-jet recording apparatus includes a pair of first rollers which transports a recording medium in a transporting direction, a platen arranged at a downstream side of the transporting direction with respect to the first rollers, and which supports the recording medium, a pair of second rollers arranged at the downstream side of the transporting direction with respect to the platen, and which transports the recording medium in the transporting direction, a recording head arranged to face the platen and which jets ink droplets onto the recording medium supported by the platen, and a guide mechanism which changes an attitude of the guide member between a first attitude in which a front end of the recording medium is guided to a nipping position of the second rollers, and a second attitude in which the front end of the recording medium is guided to a lower position than the nipping position.

12 Claims, 8 Drawing Sheets

INK-JET RECORDING APPARATUS

CROSS REFERENCE TO RELATED APPLICATION

The present application claims priority from Japanese Patent Application No. 2010-222910, filed on Sep. 30, 2010, the disclosure of which is incorporated herein by reference in its entirety.

BACKGROUND OF THE INVENTION

1. Field of the Invention

The present invention relates to an ink-jet recording apparatus which jets an ink onto a recording medium which has been transported.

2. Description of the Related Art

An ink-jet recording apparatus which includes a pair of transporting rollers and a pair of paper discharge rollers arranged to be aligned in a horizontal direction, a platen which is arranged between the pair of transporting rollers and the pair of paper discharge rollers, and a recording head which is arranged at an upper side of the platen, and which jets an ink has hitherto been provided. The recording medium is transported toward the recording head by the pair of transporting rollers, and an image is recorded thereon by the recording head from a front end side in a direction of transporting (hereinafter, "transporting direction"). As a front end of the recording medium reaches the pair of paper discharge rollers, the recording medium is transported by the pair of transporting rollers and the pair of paper discharge rollers.

In an ink-jet recording apparatus, depending on a type of the recording medium and an amount of ink jetted, sometimes the recording medium is curled to be expanded (bulged) upwardly. As the recording medium is curled, sometimes the recording medium makes a contact with the recording head. Moreover, a distance between the recording medium and the recording head may change, and an image may be disturbed, causing a problem of degradation of accuracy of image recording.

SUMMARY OF THE INVENTION

The present invention has been made in view of the above-mentioned problems, and an object of the present invention is to provide an ink-jet recording apparatus which is capable of suppressing the degradation of accuracy of image recording.

According to an aspect of the present invention, there is provided an ink-jet recording apparatus which jets ink droplets onto a recording medium, including: a pair of first rollers which transports the recording medium in a transporting direction; a platen which is arranged at a downstream side of the transporting direction with respect to the pair of first rollers and which supports the recording medium from below; a pair of second rollers which is arranged at the downstream side of the transporting direction with respect to the platen and which transports the recording medium in the transporting direction; a recording head which is arranged to be face the platen and which jets the ink droplets onto the recording medium which has been supported by the platen; and a guide mechanism which has a guide member arranged between the platen and the pair of second rollers and having a guide surface which supports the recording medium from below, and which changes an attitude of the guide member between a first attitude in which a front end of the recording medium is guided to a nipping position of the pair of second rollers, and a second attitude in which the front end of the recording medium is guided to a lower position than the nipping position, based on a position of the recording medium in the transporting direction.

According to the aspect of the present invention, in the second attitude, the guide member guides the front end of the recording medium to a lower position than the pair of second rollers. Therefore, it is possible to prevent recording medium, on which the ink is jetted and which is curled, from floating from the platen and making a contact with the recording head, or to prevent a distance between the recording head and the recording medium being shorter. As a result, it is possible to suppress a degradation of accuracy of image recording.

BRIEF DESCRIPTION OF THE DRAWINGS

FIG. 5A is a diagram showing a supporting attitude of the movable guide member, and FIG. 8B is a diagram showing a forward tilting attitude of the movable guide member.

DETAILED DESCRIPTION OF THE PREFERRED EMBODIMENTS

Figure 1:
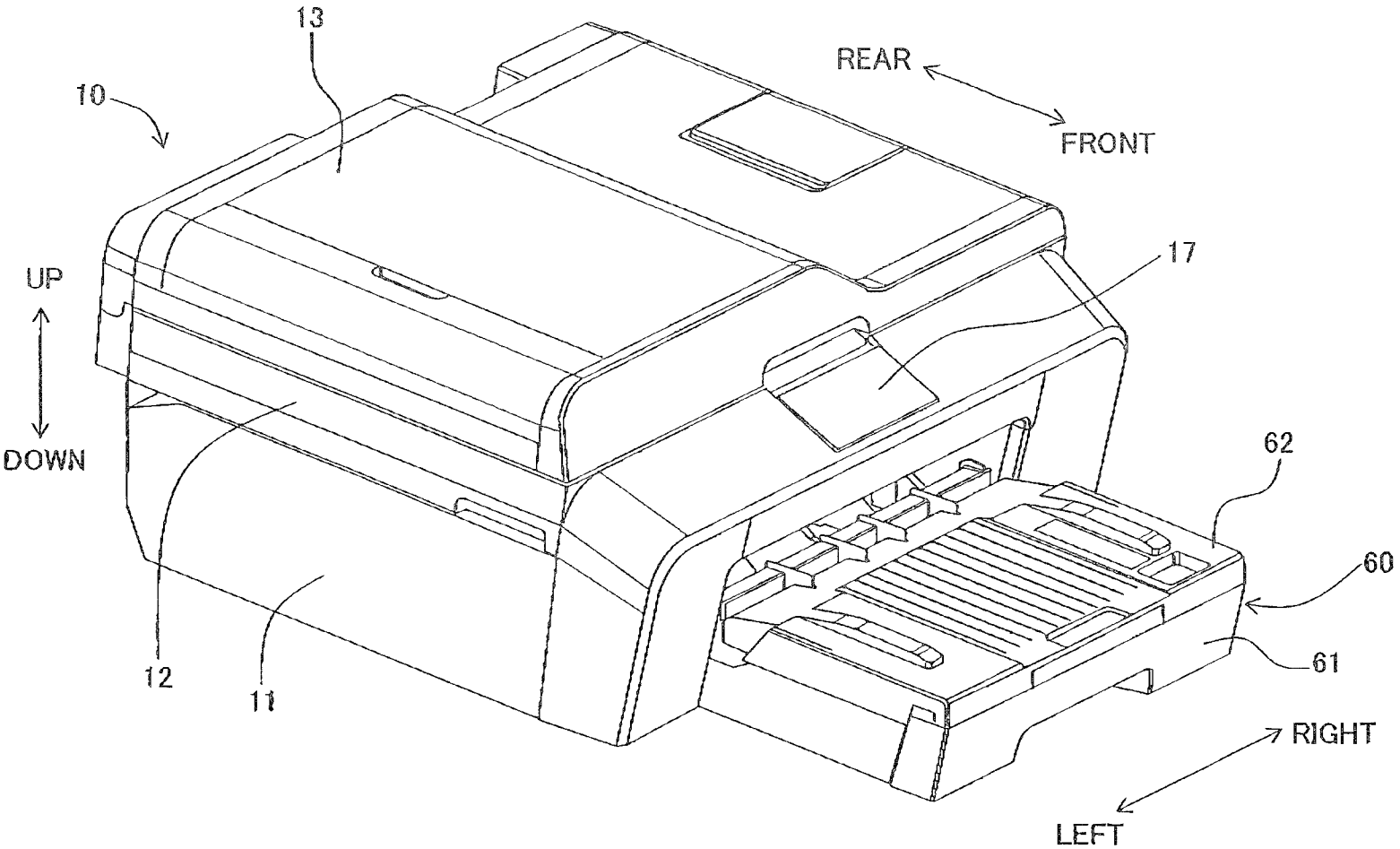
FIG. 1 is a perspective view of an ink-jet recording apparatus.

An embodiment of the present invention will be described below while referring to the accompanying diagrams. In the embodiment, an ink-jet recording apparatus 10 shown in FIG. 1 will be described. The ink-jet recording apparatus 10 is formed to be substantially boxed shape. The description is made below by defining a direction of height of the ink-jet head 10 as a vertical direction, a direction of depth as a frontward and rearward direction, and a direction of width as a left-right direction.

The ink-jet recording apparatus 10 includes a printer casing 11, a scanner casing 12 which is mounted on the printer casing 11, and which accommodates a scanner, and a document cover 13 which is mounted on the scanner casing 12. In other words, the ink-jet recording apparatus 10 is a multi-function device which is provided with functions such as a scanning, copying, and printing. However, the present invention is also applicable to a printer which has only printing function.

The printer casing 11 accommodates at a lower portion, a paper feeding cassette 60 in which recording mediums 14 (refer to FIG. 2) such as a plain paper, a glossy paper, and a postcard are accommodated and which can be drawn frontward, and accommodates at an upper portion, a printer section 16 (refer to FIG. 2) which records an image on the recording mediums 14. A state in which the paper feeding cassette 60 is drawn from the printer casing 11 is shown in FIG. 1. A control of sections such as the scanner and a printer section 16 is carried out by a control section 18 shown in FIG. 6. The control section 18 is realized by various electronic components such as a microcomputer mounted on a substrate. The control section 18 controls reading of an image and recording of an image carried out based on a signal which has been inputted from an external equipment such as a personal computer and an input section 17 shown in FIG. 1.

Figure 2:
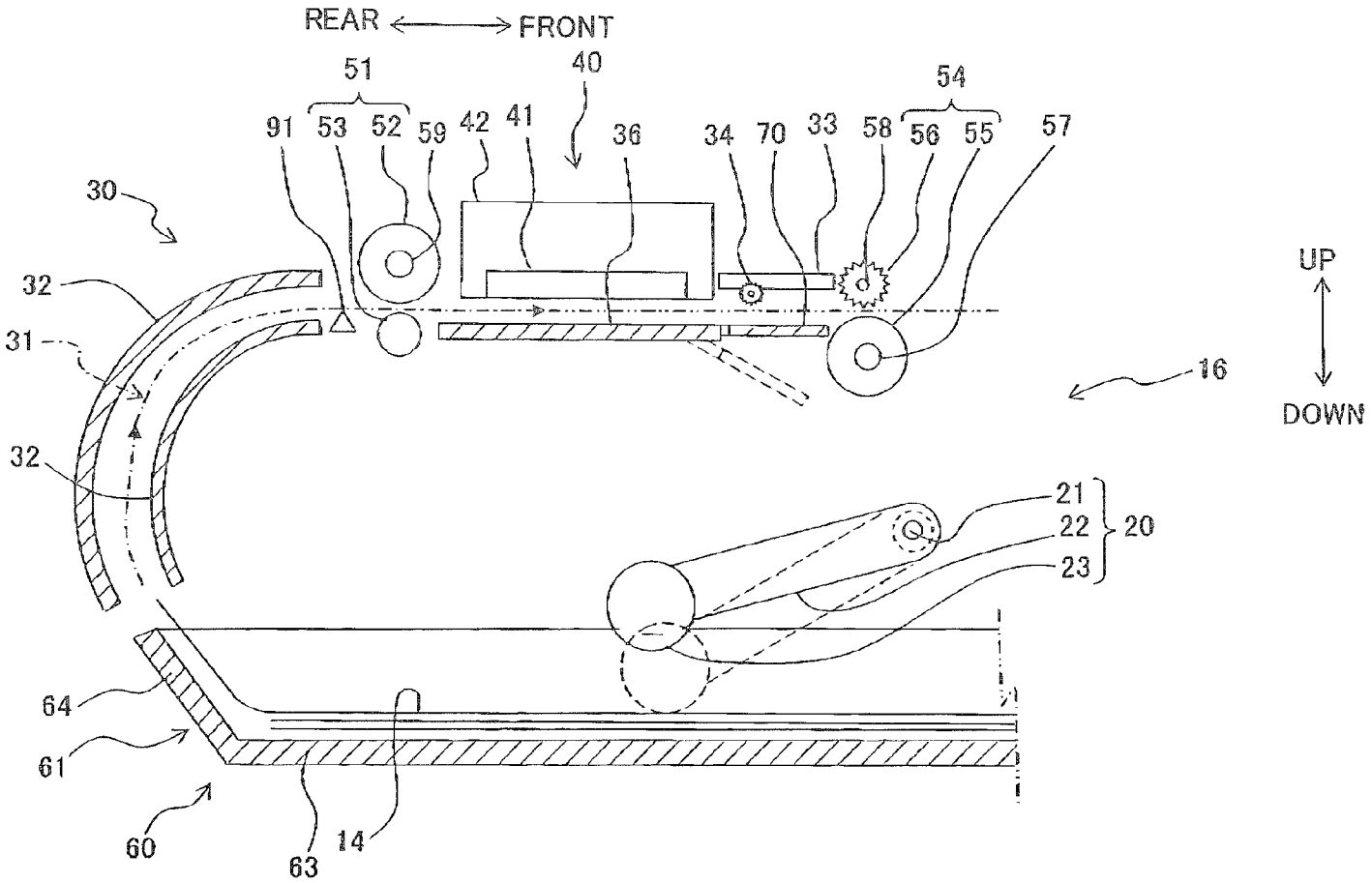
FIG. 2 is a schematic cross-sectional view of a printer section.

As shown in FIG. 1 and FIG. 2, the paper feeding cassette 60 includes a main body 61 formed to be flat rectangular parallelepiped shape, with an upper portion open, and a lid 62 which is supported by the main body 61. The recording mediums 14 are placed on a bottom 63 of the main body 61.

As shown in FIG. 2, a rear wall 64 of the main body 61 is inclined with respect to the bottom 63 to extend upward while inclining rearward from a rear end of the bottom 63. The recording medium 14 which is dispatched by a feeding mechanism 20 which will be described later is directed upward to be inclined rearward by making a sliding contact with an inner surface of the rear wall 64.

As shown in FIG. 2, the printer section 16 includes the feeding mechanism 20, a transporting mechanism 30 which transports the recording medium 14 which has been dispatched by the feeding mechanism 20, a detection mechanism 90 (refer to FIG. 6) which detects a position etc. of the recording medium 14 which has been transported by the transporting mechanism 30, a recording section 40 which records an image on the recording medium 14 which is transported, and a drive section 80 (refer to FIG. 6) which drives the feeding mechanism 20 and the transporting mechanism 30.

As shown in FIG. 2, the feeding mechanism 20 includes a first rotating shaft 21 which is rotatably supported by a frame 19 (refer to FIG. 3 and FIG. 4) which has been fixed to the printer casing 11, an arm 22 of which one end is supported by the first rotating shaft 21, and a pair of feeding rollers 23 which are rotatably supported by the other end of the arm 22. The first rotating shaft 21 is formed to be round-rod shaped, extending along a left-right direction 9, and is rotated by the drive section 80.

The one end of the arm 22 is supported by the first rotating shaft 21 so that the arm 22 is rotatable around the first rotating shaft 21 as a center. Consequently, the other end of the arm 22 on which the feeding roller 23 is installed is displaced vertically by rotation of the arm 22 around the first rotating shaft 21 as a center. When the paper feeding cassette 50 is attached to or detached from the printer casing 11, the arm 22 is rotated by making a sliding contact with a sliding-contact surface which is provided to the paper feeding cassette 60 but not shown in the diagram. The feeding roller 23 is displaced vertically by the rotation of the arm 22, and comes closer and moves away from the recording medium 14 accommodated in the paper feeding cassette 60.

The feeding roller 23 is rotated by the rotation of the first rotating shaft 21 being transmitted by a transmission gear which is installed on the arm 22 but not shown in diagram. The control section 18 rotates the feeding roller 23 via the drive section 80 in a direction in which the recording medium 14 is dispatched rearward. The recording medium 14 which has been dispatched rearward is transported by the transporting mechanism which will be described below.

As shown in FIG. 2, the transporting mechanism 30 includes a transporting path 31, a pair of main transporting rollers 51, and a pair of paper discharge rollers 54. The transporting path 31 includes members such as a guide member 32, an upper guide member 33, a movable guide member 70, and a platen 36. The transporting path 31, is formed to extend linearly in a frontward direction upon bending toward an upper side of the paper feeding cassette 60 with a rear end of the paper feeding cassette 60 as an origin. The platen 36 is arranged at the upper side of the paper feeding cassette 60, and forms a part of a portion extended linearly along a frontward direction 8 in the transporting path 31. The upper guide member 33 and the movable guide member 70 will be described later in detail.

The pair of main transporting rollers 51 includes a first drive roller 52 which is rotated by the drive section 80, and a first driven roller 53 which is driven by the first drive roller 52. The pair of main transporting rollers 51 is arranged at a rear side of the platen 36. The pair of main transporting rollers 51 corresponds to a pair of first rollers in claims of the present invention.

The pair of paper discharge rollers 54 includes a plurality of second drive rollers 55 installed on a second rotating shaft 57 in the form of a round rod extending along the left-right direction and a plurality of second driven rollers 56 which are rotatably supported by a spindle 58 in the form of a round rod extending along the left-right direction, and which are driven by the second drive rollers 55. The pair of paper discharge rollers 54 is arranged at a front side of the platen 36. The second rotating shaft 57 is driven to rotate by the drive section 80.

As shown in FIG. 2, the recording section 40 includes a recording head 41, and is held by a carriage 42 arranged at the upper side of the platen 36. The recording head 41 faces the platen 36 at the lower side, and jets ink droplets toward the recording medium 14 which is transported on the platen 36. The carriage 42 is movably supported along the left-right direction by a guide rail 43 supported by the frame 19 (refer to FIG. 3), and is moved by the drive section 80. The recording section 40 corresponds to a recording head according to the claims of the present invention.

By the movement of the carriage 42 along the left-right direction and transporting frontward of the recording medium 14, the ink-jet recording apparatus 10 is capable of recording an image on almost an entire surface of the recording medium 14. The movement of the carriage 42 is controlled by the control section 18 via the drive section 80 which is described below.

Figure 6:
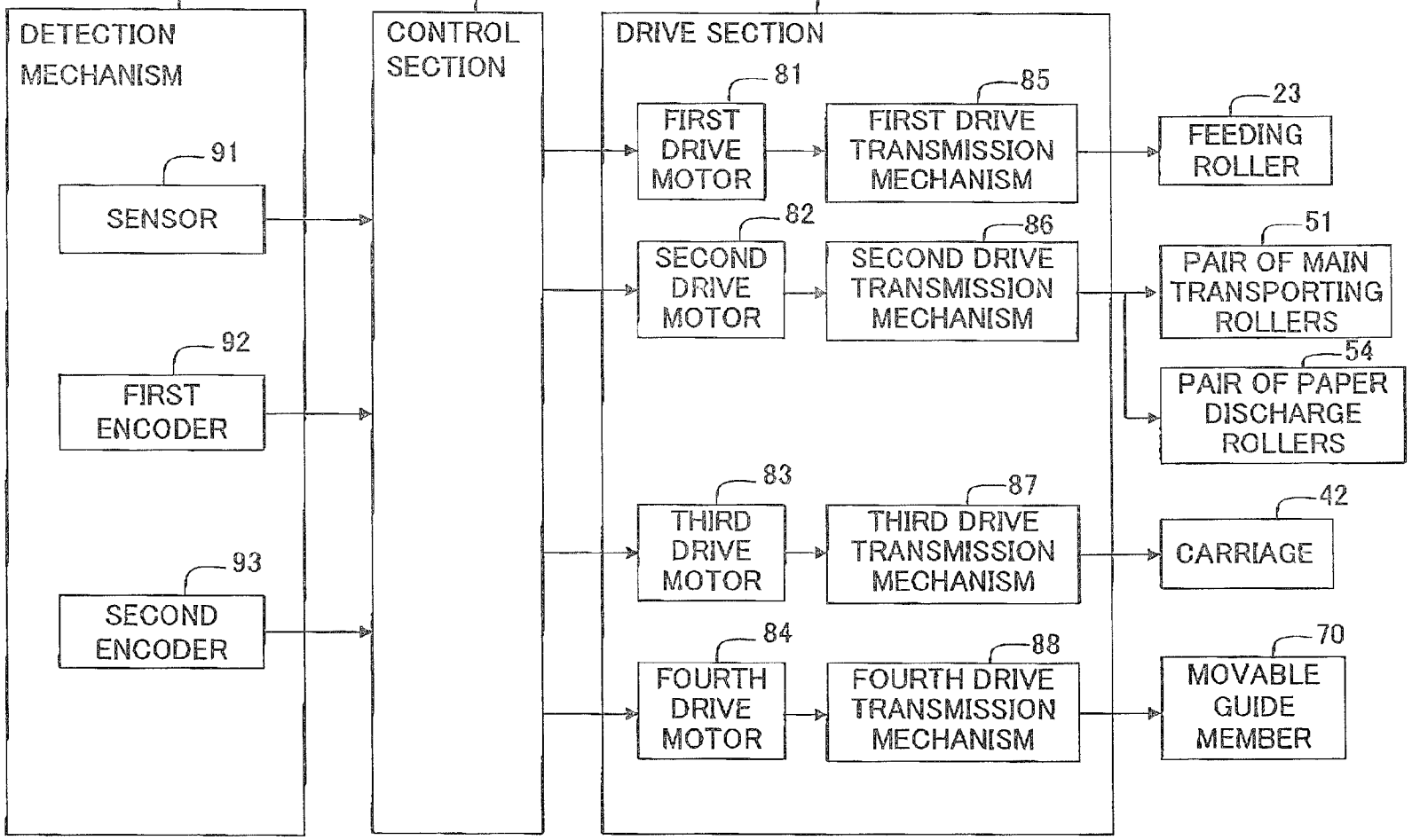
FIG. 6 is a block diagram of the ink-jet recording apparatus.

As shown in FIG. 6, the drive section 80 includes a first drive motor 81, a second drive motor 82, a third drive motor 83, and a fourth drive motor 84, and a first drive transmission mechanism 85, a second drive transmission mechanism 86, a third drive transmission mechanism 87, and a fourth drive transmission mechanism 88.

The first drive transmission mechanism 85 is a mechanism such as a gear mechanism, and transmits rotation of the first drive motor 81 to the feeding roller 23.

Figure 4:
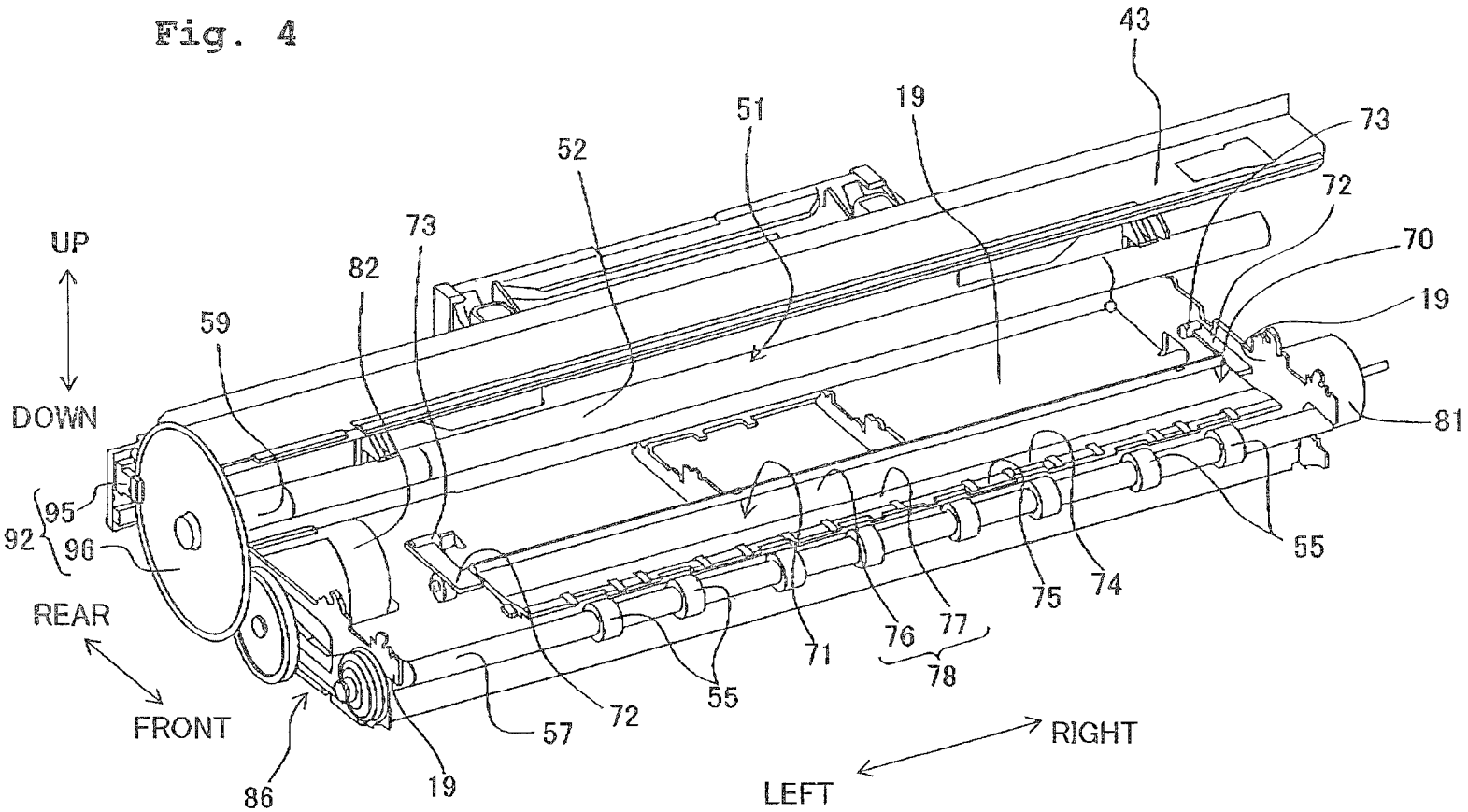
FIG. 4 is a perspective view of the printer section without the upper guide member and a platen.

As shown in FIG. 4, the second drive transmission mechanism 86 is a cam-belt mechanism, and transmits rotation of the second drive motor 82 to a first rotating shaft 59 of the first drive roller 52 and to a second rotating shaft 57 of the second drive roller 55. The pair of main transporting rollers 51 and the pair of paper discharge rollers 54 are rotated simultaneously by the second drive transmission mechanism 86 to transport the recording medium 14 in the same direction (frontward direction or rearward direction). The description is made below by letting a direction of rotation of the second drive motor 82 when the recording medium 14 is transported in the frontward direction, to be a positive rotation.

The third drive transmission mechanism 87 is a mechanism such as a cam-belt mechanism, and moves the carriage 42 (refer to FIG. 2) linearly along the left-right direction 9 by the rotation of the third drive motor 83.

The fourth drive transmission mechanism 88 is a mechanism such as a gear mechanism, and transmits rotation of the fourth drive motor 84 to the movable guide member 70 to be described later, which is rotatably provided.

As shown in FIG. 6, the detection mechanism 90 includes a sensor 91, a first encoder 92, and a second encoder 93.

As shown in FIG. 2, the sensor 91 is arranged at an upstream side with respect to the pair of main transporting rollers 51 in the transporting direction. The sensor 91 is a so-called resist sensor and includes a photointerrupter having a light emitting diode and a photodiode, and a probe which is provided to appear and disappear in the transporting path 31. Light from the light emitting diode is prevented from reaching the photodiode by an attitude of the probe being changed by the recording medium 14 which has been transported, and an output of the sensor 91 changes. In other words, the output of the sensor varies between while the recording medium 14 is passing a location at which the probe is provided and when the recording medium 14 does not pass the location at which the probe is provided. The description is made below by letting the output of the sensor 91, while the recording medium 14 is passing, to be a first output, and the output of the sensor 91, when the recording medium 14 does not pass, to be a second output. The sensor 91 corresponds to a first detecting section according to the claims of the present invention.

Figure 3:
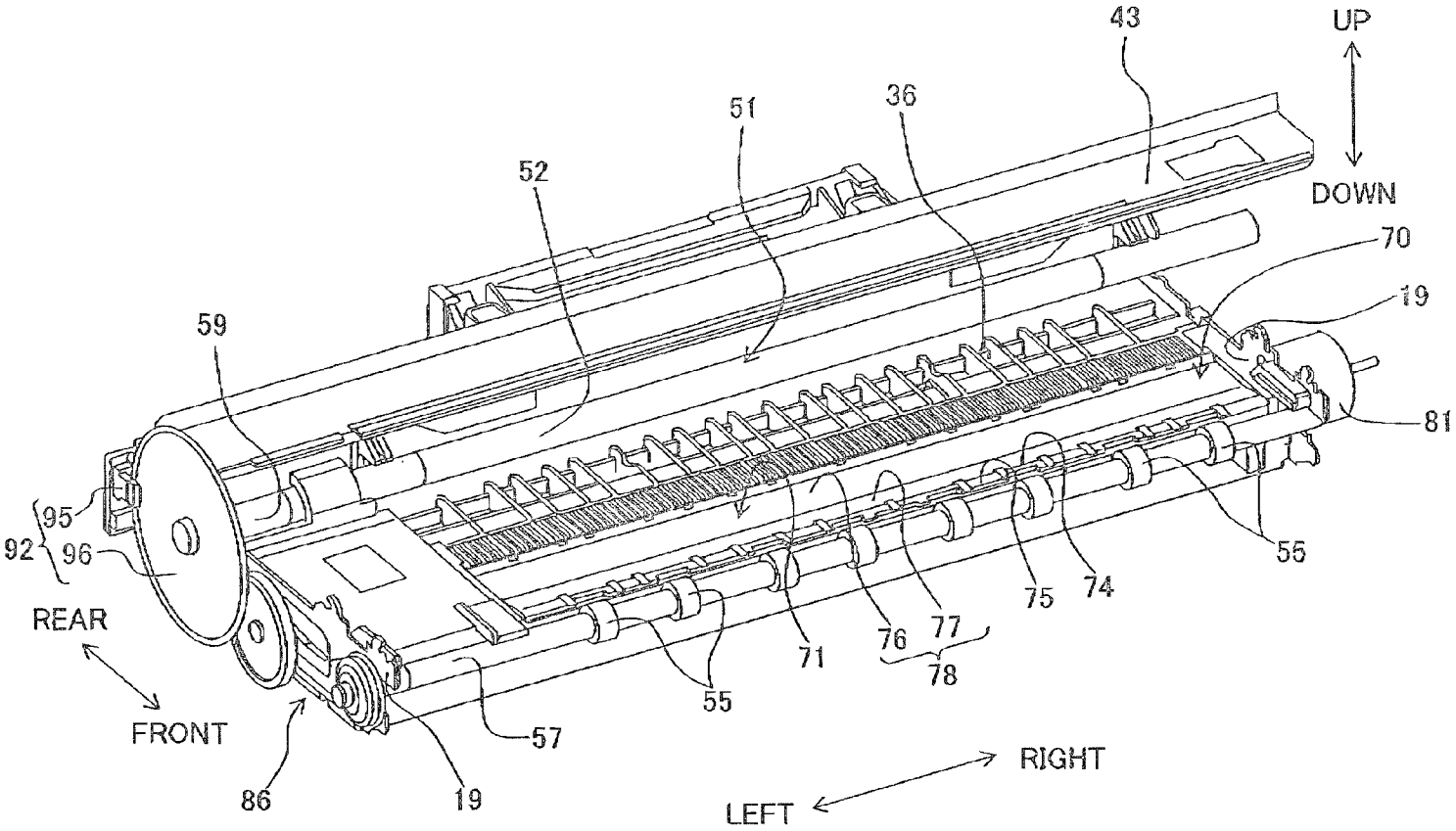
FIG. 3 is a perspective view of the printer section without an upper guide member.

As shown in FIG. 3, the first encoder 92 includes a photointerrupter 95 and a disc 96 which is installed on the first rotating shaft 59 of the first drive roller 52, and has a structure in which the disc 96 is provided with a light transmission portion through which light is transmitted and a light shielding portion (not shown in the diagram) which shields light. By the rotation of the disc 96, the light transmission portion and the light shielding portion pass an optical path alternately, and an output of the first encoder 92 changes. In other words, the output of the first encoder 92 changes at a frequency (the number of times) corresponding to a rotation amount of the first drive roller 52. Consequently, the frequency of the change in the output of the first encoder 92 corresponds to a moving amount of the recording medium 14. The description will be made below by letting the moving amount of the recording medium 14 to be a transporting amount. The first encoder 92 corresponds to a second detecting section according to the claims of the present invention.

The second encoder 93 includes a photointerrupter and a disc which is installed on the first drive motor 81 or the first rotating shaft 21. An output of the second encoder 93 changes at a frequency corresponding to an amount of rotation of the first drive motor 81 or the first rotating shaft 21.

The control section 18 includes a counter which counts the change in the output of the first encoder 92 and the second encoder 93, and calculates the transporting amount of the recording medium 14 from the number of counts counted by the counter.

The detection mechanism 90 is to be used for a position detection of the recording medium 14 on the platen 36, a registration correction of the recording medium 14, and an attitude change of the movable guide member 70 in a first recording process which will be described later.

The registration correction is carried out by the pair of main transporting rollers 51. When the control section 18 detects that a front end of the recording medium 14 in the transporting direction has reached the pair of main transporting rollers 51, according to an input value from the sensor 91 and the first encoder 92, the control section 18 rotates the second drive motor 82 in the positive direction after rotating in the reverse direction for a predetermined time. The recording medium 14, after being stopped by the pair of main transporting rollers 51 undergoing reverse rotation, and subjected to the registration correction, is transported by the positive rotation of the second drive motor 82. The detection of the position of the front end of the recording medium 14 is carried out by comparing the frequency of the change in output of the first encoder 92 after the output of the sensor 91 has changed from the second output to the first output, and a predetermined value which has been stored in a storage section which is not shown in the diagram, by the control section 18.

Figure 5:
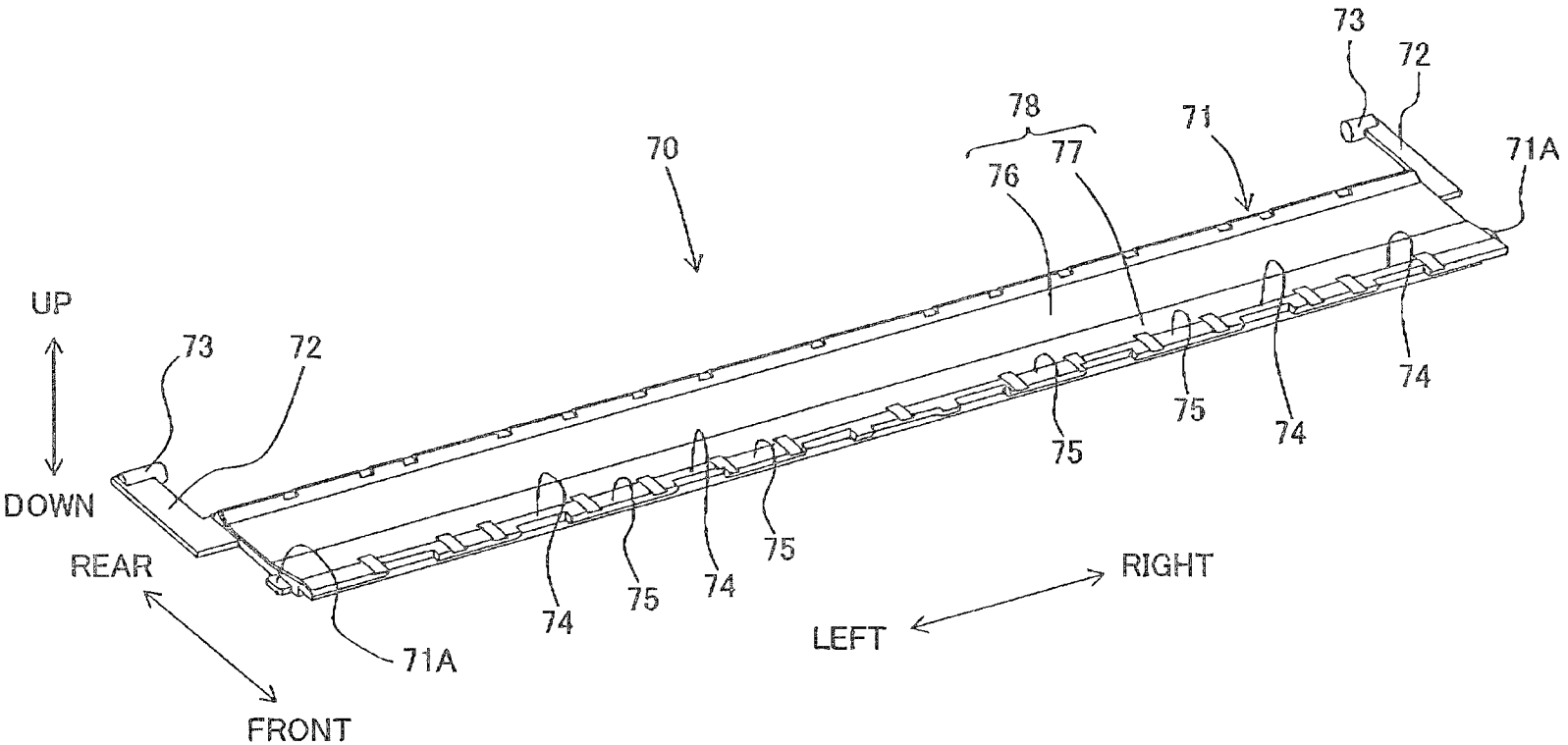
FIG. 5 is a perspective view of a movable guide member.

The movable guide member 70 is arranged between the platen 36 and the pair of paper discharge rollers 54 in the transporting direction shown by arrows in FIG. 2. In other words, the movable guide member 70 is arranged at a downstream side with respect to the platen 36 in the transporting direction, and an upstream side with respect to the pair of paper discharge rollers 54 in the transporting direction. As shown in FIG. 5, the movable guide member 70 includes a base portion 71 in the form of a plate, protruding pieces 72 which are protruded rearward from rear-end portions of left and right end portions of the base portion 71 respectively, and shaft protruding portions 73 in the form of circular cylinders which protrude in a direction approaching each other from rear-end portions of the protruding pieces 72, respectively. The shaft protruding portions 73 are pivotably supported by the frame 19 and the platen 36 (refer to FIG. 4). In other words, the movable guide member 70 is pivotable around the shaft protruding portion 73*s* as a center. The shaft protruding portions 73 corresponds to a pivot shaft according to the claims of the present invention.

Figure 8A:
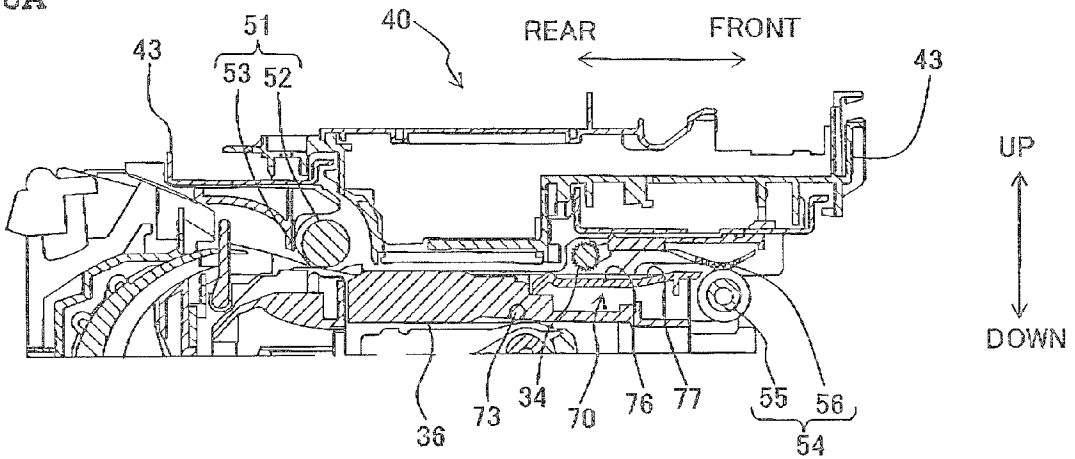
FIG. 8A and FIG. 8B are enlarged views of a cross-section of the printer section, where
Figure 8B:
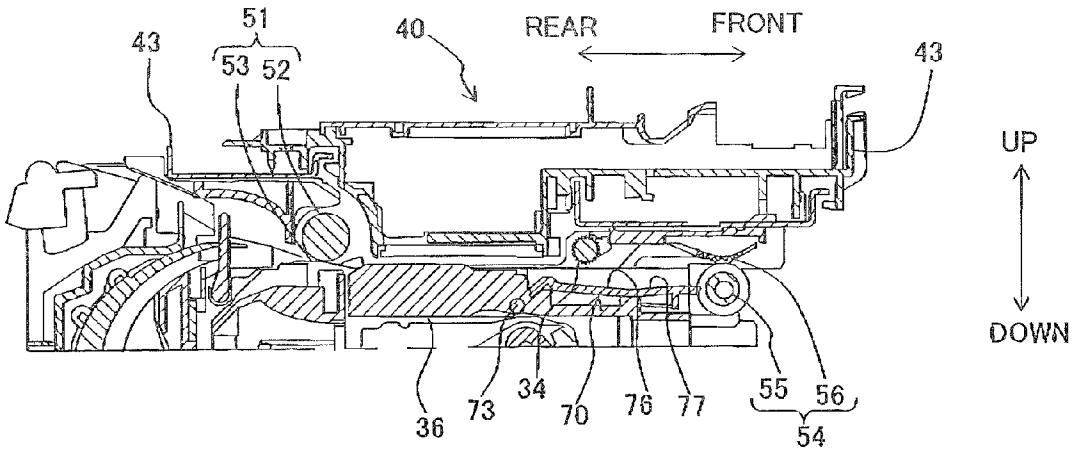

The movable guide member 70, by being rotated, changes an attitude to a supporting attitude in which the recording medium 14 can be guided to a nipping position of the pair of paper discharge rollers 54 (a solid line in FIG. 2, and FIG. 8A), and a forward tilting attitude in which a front-end portion is positioned at a position which is lower than the position in the supported attitude and which is lower than an upper surface of the platen 36 (dashed line in FIG. 2, and FIG. 8B). The supported attitude corresponds to a first attitude according to the claims of the present invention, and the forward tilting attitude corresponds to a second attitude according to the claims of the present invention).

As shown in FIG. 3 and FIG. 4, a guide surface 75, which is an upper surface of the movable guide member 70 in the supported attitude, is provided with a first surface 76 at a rear-end side which is horizontal in the supported attitude, and a second surface 77 at a front-end side which rises up toward a front in the supported attitude.

The movable guide member 70 includes a plurality of first guide ends 74 and second guide ends 75, as a front end in the supported attitude. Each of the first guide ends 74 is provided at a position facing the pair of paper discharge rollers 54 in the frontward and rearward direction. Each of the second guide ends 75 is provided between the adjacent first guide ends 74, and facing a space between the second drive rollers 55 which are formed to be separated. The second guide ends 75 protrude forward over the first guide ends 74, and extend toward an upstream side with respect to an outer periphery of the pair of paper discharge rollers 54 in the transporting direction, up to an area near the second rotating shaft 57. A dimension protruding from a front end of the first guide end 74 in the second guide end 75 is set to be such that the second guide end 75 comes closer to the nipping position of the pair of paper discharge rollers 54. By the second guide end 75 being provided, it is possible to guide the recording medium 14 up to a position closer to the nipping position, and it is possible to reduce a possibility of jamming of paper at the pair of paper discharge rollers 54. The first guide end 74 corresponds to a first end according to the claims of the present invention. The second guide end 75 corresponds to a second end according to the claims of the present invention.

The movable guide member 70 is turned by gears installed on the protruding pieces 72 respectively being rotated by the fourth drive motor 84 and the fourth drive transmission mechanism 88, and changes the attitude. The movable guide member 70, which has been turned by the positive rotation or the reverse rotation of the fourth drive motor 84, stops in the supported attitude or the forward tilting attitude by a stopper 71A making a contact with the other member. The description will be made below by letting the rotation of the fourth drive motor 84 in a direction, in which the movable guide member 70 changes the attitude from the supported attitude to the forward tilting attitude, to be the positive rotation, and by letting the rotation of the fourth drive motor 84 in a direction, in which the movable guide member 70 changes the attitude from the forward tilting attitude to the supported attitude, to be the reverse rotation.

In the embodiment, the movable guide member 70 is a molding of a synthetic resin, and is smaller in weight than one formed of a metallic material. The movable guide member 70 maintains the supported attitude or the forward tilting attitude when no external force is exerted, by a frictional force generated between the shaft protruding portions 73 and the frame 19 (or the platen 36). Or, a rib is provided to each of the outer peripheral surfaces of the shaft protruding portions 73 and the frame 19 (or the platen 36). By crossing of the one rib over the other rib due to a torque of the fourth drive motor 84, and by the two ribs making a mutual contact, the turning of the movable guide member 70 is regulated, and the supported attitude or the forward tilting attitude is maintained.

The upper guide member 33 is arranged at an upper side of the movable guide member 70. A spur roller 34 is rotatably provided to the upper guide member 33. The spur roller 34 is arranged above a rear-end portion of the movable guide member 70, and faces the first surface 76 of the movable guide member 70 in a vertical direction. The spur roller 34 corresponds to a third roller according to the claims of the present invention.

The control section 18 controls the first drive motor 81 to rotate in the positive direction thereby transporting the recording medium 14 accommodated in the paper feeding cassette 60 up to the pair of main transporting rollers 51, and carrying out the abovementioned register correction. Next, the control section 18 controls the second drive motor 82 to rotate intermittently, and thereby transporting the recording medium 14 intermittently. The control section 18 controls the recording section 40 to move and jet ink droplets while the movement of the recording medium 14 is stopped. The control section 18 controls a line feed by transmitting intermittently by the transporting amount of the recording medium 14 which has been detected by the first encoder 92. The control section 18, after recording an image on the recording medium 14, controls the second drive motor 82 to rotate in positive direction, and thereby discharging the recording medium 14 from the pair of paper discharge rollers 54.

In the embodiment, the control section 18 is provided to be capable of carrying out a first recording process and a second recording process, each having a different movement of the movable guide member 70. When a print instruction is inputted by a user by an input operation on the input section 17, or when a print instruction is inputted from an external equipment, the control section 18 selects one of the first recording process and the second recording process based on information about a jetting amount of ink which has been judged from image data and a type of the recording medium in the print instruction. Concretely, when an image is to be recorded on the recording medium 14 having a high stiffness, such as a glossy paper and a board paper, and when the jetting amount of ink is small, the control section selects the second recording process, and when an image is to be recorded on the recording medium having a low stiffness such as a plain paper, and when the jetting amount of ink is large, the control section 18 selects the first recording process.

A judgment of as to which recording process is to be selected by the control section 18 is made depending on whether or not information about the type of the recording medium 14 matches with information stored in the storage section which is not shown in the diagram, and whether or not a frequency of jetting of ink droplets judged from the image data is higher than a predetermined value of frequency stored in the storage section. The information about the type of the recording medium 14 corresponds to type information according to the claims of the present invention. Moreover, information about jetting frequency of the ink judged from the image data corresponds to information of ink amount according to the claims of the present invention.

A description of an attitude control of the movable guide member 70 in the control section 18 in the second recording process will be made below. The control section 18, in a case of selecting the second recording process, controls the fourth drive motor 84 to rotate in reverse direction before the front end of the recording medium 14 in the transporting direction reaches the movable guide member 70, and lets the attitude of the movable guide member 70 to be the supported attitude. For instance, the control section 18 controls the fourth drive motor 84 to rotate in the reverse direction in cases such as, before dispatching and immediately after dispatching the recording medium 14 by rotating the first drive motor 81, and immediately after the output of the sensor 91 has changed from the second output to the first output, namely, immediately after the front end of the recording medium 14 has reached the sensor 91.

The control section 18 does not rotate the fourth drive motor 84 in the positive direction until the recording medium 14 is discharged, and maintains the state in which the movable guide member 70 is in the supported attitude. The front end of the recording medium 14 having a high stiffness and on which the ink droplets are jetted by the recording head 41 is guided on the platen 36 to the first surface 76 of the movable guide member 70 in the transporting direction, and enters between the movable guide member 70 and the spur roller 34. Thereafter, the front end of the recording medium 14 is guided to the nipping position of the pair of paper discharge rollers 54 by the first guide end 74 and the second guide end 75 of the movable guide member 70. Next, the recording medium 14 is discharged to outside of the apparatus by the pair of paper discharge rollers 54.

Figure 7:
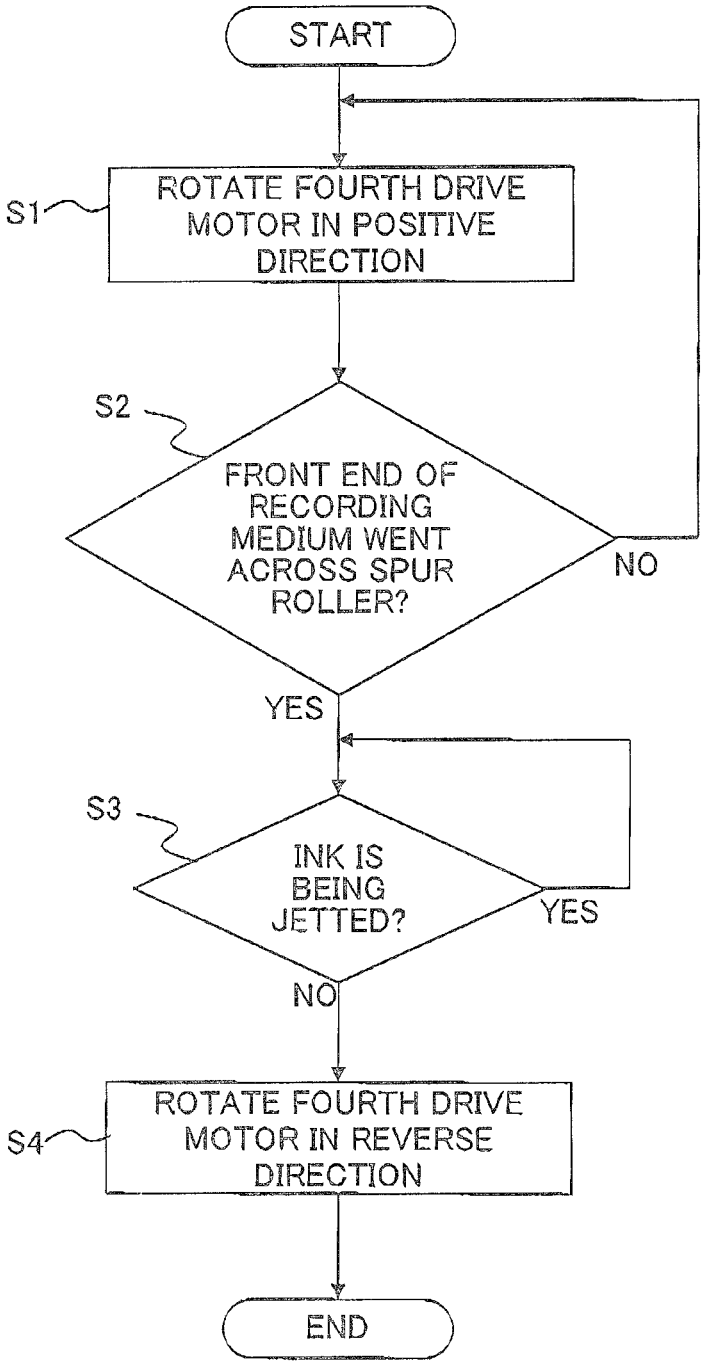
FIG. 7 is a flowchart showing an attitude control of the movable guide member in a first recording process.

The attitude control of the movable guide member 70 by the control section 18 in the first recording process will be described below by referring to a flowchart in FIG. 7. The control section 18, in a case of selecting the first recording process, rotates the fourth drive motor 84 in the positive direction until the front end of the recording medium 14 in the transporting direction reaches a rear end of the base portion 71 of the movable guide member 70 (step S1), and lets the movable guide member 70 to be in the forward tilting attitude shown in FIG. 8B. The control section 18 controls the fourth drive motor 84 to rotate in the positive direction in cases such as, before dispatching and immediately after dispatching the recording medium 14 by rotating the first drive motor 81, and immediately after the output of the sensor 91 has changed from the second output to the first output, namely, immediately after the front end of the recording medium 14 has reached the sensor 91.

Thereafter, the control section 18 monitors a position of the front end of the recording medium 14 being transported by the pair of main transporting rollers 51 by monitoring a frequency of change in the output of the first encoder 92 (step S2), and waits until the frequency of the change in the output of the first encoder 92 exceeds a first predetermined value which has been stored in the storage section, and the front end of the recording medium 14 goes across a position of the spur roller 34 (No at step S2). Based on a rotation amount of the pair of main transporting rollers 51, namely, based on the transporting amount of the recording medium 14, when the control section 18 makes a judgment that the front end of the recording medium has gone across the position of the spur roller 34 in the transporting direction (Yes at step S2), the control section 18 makes a judgment of whether or not the ink droplets are being jetted from the recording head 41 (step S3). When the control section 18 makes a judgment that the ink droplets are being jetted from the recording head 41 at step S3, (Yes at step S3), the control section 18 waits until the jetting of the recording head 41 is completed. Moreover, when the control section 18 makes a judgment that the ink droplets are not being jetted (No at step S3), the control section 18 controls the fourth drive motor 84 to rotate in the reverse direction (step S4), and changes the attitude of the movable guide member 70 from the forward tilting attitude to the supported attitude.

The time during which the ink droplets are not being jetted at step S3 means a time during line feeding which is transporting up to a predetermined position of the recording medium 14 by the transporting mechanism 30, a time after the ink droplets are jetted and before the line feeding starts, and a time after the line feeding and before the ink droplets are jetted.

The reverse rotation of the fourth drive motor 84 at step S4 is carried out while the front end of the recording medium 14 does not reach the nipping position of the pair of paper discharge rollers 54 in a case when the movable guide member 70 is returned from the forward tilting attitude to the supported attitude. For instance, when the frequency of the change in the output of the first encoder 92 after the output of the sensor 91 has changed from the second output to the first output has reached a second predetermined value which has been stored in the storage section, the control section 18 controls the fourth drive motor 84 to rotate in the reverse direction.

In the first recording process, the front end of the recording medium 14 having a low stiffness with a large amount of ink jetted thereon by the recording section 40 is transported downward by the movable guide member 70 in the forward tilting attitude. Thereafter, the recording medium 14 is transported forward while the front end thereof sliding on the second surface 77. The recording medium 14, after the front end thereof has gone across the spur roller 34, is pinched between the movable guide member 70 and the spur roller 34, by the movable guide member 70 changing the attitude from the forward tilting attitude to the supported attitude. The front end of the recording medium 14 is guided to the nipping position of the pair of paper discharge rollers 54 by the first guide end 74 and the second guide end 75 which are the front end portions of the movable guide member 70. By the spur being used, a contact area of the spur roller 34 and a printing surface of the recording medium 14 is reduced.

The movable guide member 70, the fourth drive motor 84, and the fourth drive transmission mechanism 88 correspond to a guide mechanism according to the claims of the present invention.

In the ink-jet recording apparatus according to the embodiment, in the first recording process, the front end of the recording medium 14 having the low stiffness with the large amount of ink jetted thereon, is transported downward by the movable guide member 70 which is in the forward tilting attitude. As the front end is transported downward, even when the recording medium 14 has curled due to the large amount of ink being jetted thereon, it is possible to prevent the recording medium 14 from being lifted up from the platen 36. Therefore, it is possible to prevent the recording medium 14 from making a contact with the recording section 40, and moreover, it is possible to suppress the distance between the recording medium 14 and the recording head 41 from changing. As a result, it is possible to carry out image recording with a high accuracy.

Moreover, by the attitude of the movable guide member 70 being changed to the forward tilting attitude, the movable guide member 70 is separated away from the spur roller 34. Therefore, it is possible to reduce a possibility that the recording medium 14 which is curled is jammed between the spur roller 34 and the movable guide member 70.

At the time of changing the attitude of the movable guide member 70 from the forward tilting attitude to the supported attitude, it is possible to press the recording medium 14 against the movable guide member 70 by the spur roller 34. Accordingly, it is possible to carry out image recording with higher accuracy.

Further, in the ink-jet recording apparatus 10 according to the embodiment, by the first recording process and the second recording process being prepared, even in a case of recording an image on the recording medium 14 having a high stiffness, and even in a case of recording an image on the recording medium 14 having a low stiffness, it is possible to carry out image recording with high accuracy.

Moreover, in the ink-jet recording apparatus 10 according to the embodiment, the first recording process is prepared by using the detection mechanism 90 which is provided for the registration correction and the line feeding. In other words, the ink-jet recording apparatus 90 according to the present invention is capable of improving an accuracy of image recording without providing a sensor newly.

In the ink-jet recording apparatus 10 according to the embodiment, since the attitude of the movable guide member 70 is changed from the forward tilting attitude to the supported attitude while the ink droplets are not jetted, the image is not disturbed due to the change in the attitude of the movable guide member 70.

Moreover, in the ink-jet recording apparatus 10 according to the embodiment, the movable guide member 70 is pivotally provided, and it is possible to change the attitude of the movable guide member 70 by a simple structure.

In the ink-jet recording apparatus 10 according to the embodiment, the shaft protruding portions 73 are provided at the rear side of the base portion 71 of the movable guide member 70, and by a simple structure, it is possible to raise and lower the front end portion of the movable guide member 70 which is a guide end.

Moreover, in the ink-jet recording apparatus 10 according to the embodiment, by providing the second guide ends 75 apart from the first guide ends 74, it is possible to guide the front end of the recording medium 14 to the nipping position of the pair of paper discharge rollers 54 assuredly.

Moreover, in the ink-jet recording apparatus 10 according to the embodiment, by providing the second surface 77 apart from the first surface 76 to the movable guide member 70, it is possible to guide the recording medium 14 to the pair of paper discharge rollers 54 smoothly.

In the embodiment, an arrangement in which the present invention is applied to the ink-jet recording apparatus 10 in which the curved portion is provided to the transporting path 31, has been described. However, the present invention is also applicable to an ink-jet recording apparatus in which the transporting path 31 is formed to be linear.

Moreover, in the embodiment, an arrangement in which the position of the front end of the recording medium 14 is detected by the detection mechanism 90 has been described. However, an arrangement in which the position of the front end of the recording medium 14 is detected by other detection mechanism may also be used. For instance, the position of the front end of the recording medium 14 may be detected by using a media sensor, which is provided to the recording section 40 and which is capable of detecting the front end of the recording medium 14 transported on the platen 36, and the first encoder 92. Moreover, a sensor which exclusively detects the position of the front end of the recording medium 14 may be provided.

In the embodiment, the spur roller 34 is provided as a single spur roller. However, the spur roller 34 may be constructed by a plurality of spur rollers which are arranged coaxially.

Moreover, in the embodiment, an arrangement in which the spur roller 34 is provided has been described. However, it is also possible to use a structure in which the spur roller 34 is not provided.

Moreover, in the embodiment, an arrangement in which the recording process is selected based on the types of the recording medium 14 different in the stiffness, and the amount of ink which has been judged from the image data has been described. However, an arrangement in which the recording process is selected only by the types of the recording medium 14 may be used, and an arrangement in which the recording process is selected only by the amount of ink may be used. Furthermore, irrespective of the types of the recording medium 14 and the amount of ink, the movable guide member 70 may be operated by the first recording process all the time. Moreover, in a case of determining the recording process to be selected by the amount of jetting of ink, a recording process to be selected may be determined by the total amount of the ink to be jetted on the recording medium 14, or a recording process to be selected may be determined by the jetting amount of the ink at the front-end side of the recording medium 14 in the transporting direction. In other words, in a case of image recording in which the front-end side of the recording medium 14 in the transporting direction is not curled, the control section 18 may select the second recording process.

Moreover, in the embodiment, an arrangement in which, the attitude of the movable guide member 70 changes by rotational movement has been described. However, an arrangement in which the attitude of the movable guide member 70 is to be changed by sliding along a vertical direction may be used. For instance, a guide rail which extends along the vertical direction may be provided to the frame 19, and the movable guide member 70 may be slidable along the vertical direction by a cam-belt mechanism being used as the fourth drive transmission mechanism.

In the embodiment, in the first recording process, an arrangement has been made such that the attitude of the movable guide member 70 is changed while the recording head 41 is not jetting the ink. However, an arrangement in which the attitude of the movable guide member 70 is changed while the recording head 41 jets the ink may be used. When such an arrangement is used, since it is possible to change the attitude of the movable guide member 70 without stopping a printing operation which includes the line feeding and the ink jetting, the time required for image recording does not become long due to the changing of the attitude of the movable guide member 70. As a result, it is possible to prepare the first recording process without changing an image recording time. Moreover, since the transporting of the recording medium 14 is stopped while the recording head 41 jets the ink, even when the attitude of the movable guide member 70 is changed from the forward tilting attitude to the supported attitude, there is no jamming of the recording medium 14 at the spur roller 34. As a result, it is possible to prepare the first recording process without changing the image recording time, and it is possible to transport the recording medium 14 properly.

Further, in the embodiment, in the first recording process, an arrangement in which the attitude of the movable guide member 70 is changed while the recording head 41 is not jetting the ink has been described. However, an arrangement in which the attitude of the movable guide member 70 is changed from the forward tilting attitude to the supported attitude while the line feeding is being carried out, or in other words, while the recording medium 14 is being transported, irrespective of whether or not the ink has been jetted, may be used. When such an arrangement is used, since it is possible to change the attitude of the movable guide member 70 without stopping the printing operation, the time required for image recording does not become long due to the changing of the attitude of the movable guide member 70.

In the embodiment, an arrangement in which the attitude of the movable guide member 70 is changed by the fourth drive motor 84 has been described. However, an arrangement in which the attitude of the movable guide member 70 is changed by using an existing motor such as the first drive motor 81 which drives the feeding roller 23 may be used. For instance, by using a one-way clutch, the first rotating shaft 21 may be rotated in one rotation direction of the first drive motor 81, and the attitude of the movable guide member 70 may be changed from the supported attitude to the forward tilting attitude by a half-turn in the opposite direction, and the attitude of the movable guide member 70 may be changed from the forward tilting attitude to the supported attitude by the remaining half-turn. Instead of the arrangement of changing the attitude of the movable guide member 70 at each half-turn, an arrangement in which a bias applying member which applies a bias to the movable guide member 70 in a direction of changing the attitude from the forward tilting attitude to the supported attitude, may be provided, and the movable guide member 70 is held in the forward tilting attitude by continuing to rotate the fourth drive motor in the opposite direction, may be used. Moreover, an arrangement in which the attitude of the movable guide member 70 is changed by the existing motor such as the first drive motor 81 by using a hitherto known gear switching mechanism may be used. By using the existing motor such as the first drive motor 81, it is possible to reduce further, the number of components.

What is claimed is:

1. An ink jet recording apparatus which jets ink droplets onto a recording medium, comprising;

a pair of first rollers which transports the recording medium in a transporting direction;

a platen which is arranged at a downstream side of the transporting direction with respect to the pair of first rollers and which supports the recording medium from below;

a pair of second rollers which is arranged at the downstream side of the transporting direction with respect to the platen and which transports the recording medium in the transporting direction;

a recording head which is arranged to be face the platen and which jets the ink droplets onto the recording medium which has been supported by the platen; and a guide mechanism which has a guide member arranged between the platen and the pair of second rollers and having a guide surface which supports the recording medium from below, and which changes an attitude of the guide member between a first attitude in which a front end of the recording medium is guided to a nipping position of the pair of second rollers, and a second attitude in which the front end of the recording medium is guided to a lower position than the nipping position, based on a position of the recording medium in the transporting direction.

2. The ink-jet recording apparatus according to claim 1, wherein the guide mechanism changes the attitude of the guide member so that the guide member has the second attitude before the front end of the recording medium reaches the guide surface, and the guide member has the first attitude before the front end of the recording medium reaches the pair of second rollers.

3. The ink-jet recording apparatus according to claim 1, further comprising a control section which controls the pair of first rollers, the pair of second rollers, the recording head, and the guide mechanism to selectively carry out a first recording process in which the attitude of the guide member is changed to one of the first attitude and the second attitude based on a position of the recording medium in the transporting direction, and a second recording process in which the attitude of the guide member is the first attitude irrespective of the position of the recording medium in the transporting direction.

4. The ink-jet recording apparatus according to claim 3, wherein the control section selects one of the first recording process and the second recording process based on a type information which indicates a type of the recording medium.

5. The ink-jet recording apparatus according to claim 3, wherein the control section selects one of the first recording process and the second recording process based on an ink-amount information which indicates an amount of ink to be jetted from the recording head.

6. The ink-jet recording apparatus according to claim 3, wherein the control section controls at least one of the pair of first rollers and the pair of second rollers to transport the recording medium supported by the platen intermittently, and controls the recording head to jet the ink droplets onto the recording medium while the transporting of the recording medium is stopped, and controls the guide mechanism to change the attitude of the guide member while the ink droplets are not being jetted from the recording head.

7. The ink-jet recording apparatus according to claim 3, further comprising:

a first detecting section which is provided at the upstream side of the transporting direction with respect to the guide surface and which detects the front end of the recording medium; and a second detecting section which detects a transporting amount of the recording medium, wherein the control section changes the attitude of the guide member based on a detection result of the first detecting section and the second detecting section.

8. The ink-jet recording apparatus according to claim 1, further comprising a third roller which is arranged to face the guide surface and which makes a contact with the recording medium from an upper side of the recording medium which is transported on the guide surface, wherein the guide mechanism makes the guide member have the second attitude before the front end of the recording medium reaches a position of the third roller in the transporting direction, and changes the attitude of the guide member from the second attitude to the first attitude after the front end of the recording medium has reached the position of the third roller in the transporting direction.

9. The ink-jet recording apparatus according to claim 1, wherein the guide member has a pivot shaft, and the guide mechanism changes the attitude of the guide member by turning the guide member around the pivot shaft as a center.

10. The ink-jet recording apparatus according to claim 9, wherein the pivot shaft is provided at an upstream side of the guide member in the transporting direction, and a downstream side portion of the guide member in the transporting direction is turned around the pivot shaft.

11. The ink-jet recording apparatus according to claim 1, wherein the pair of second rollers is provided as a plurality of pairs of second rollers aligned in a direction of the pivot shaft, and the guide member has a first end which is positioned at an upstream side of the transporting direction with respect to the nipping position of the pair of second rollers in the first attitude, and a second end which is projected toward the pivot shaft of the pairs of second rollers from the first end, and which is positioned between adjacent pairs of second rollers in the first attitude.

12. The ink-jet recording apparatus according to claim 1, wherein the guide surface of the guide member includes a first surface which is arranged at an upstream side of the transporting direction and which is along the transporting direction in the first attitude, and a second surface which is arranged at the downstream side of the transporting direction, and which is gradually inclined upwardly toward the downstream side of the transporting direction in the first attitude.

* * * * *